US012599269B2

(12) United States Patent
Stout

(10) Patent No.: US 12,599,269 B2
(45) Date of Patent: Apr. 14, 2026

(54) TILEABLE RECEPTOR

(71) Applicant: Kohler Co., Kohler, WI (US)

(72) Inventor: Kenneth L. Stout, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 860 days.

(21) Appl. No.: 17/876,160

(22) Filed: Jul. 28, 2022

(65) Prior Publication Data

US 2023/0051458 A1 Feb. 16, 2023

Related U.S. Application Data

(60) Provisional application No. 63/231,935, filed on Aug. 11, 2021.

(51) Int. Cl.
*A47K 3/40* (2006.01)

(52) U.S. Cl.
CPC ..... *A47K 3/40* (2013.01)

(58) Field of Classification Search
CPC ..... A47K 3/40
See application file for complete search history.

(56) References Cited

U.S. PATENT DOCUMENTS

| | | | | |
|---|---|---|---|---|
| 3,992,825 | A | 11/1976 | May | |
| 4,557,004 | A | 12/1985 | Piana | |
| 5,371,980 | A | 12/1994 | Dix | |
| 5,845,347 | A * | 12/1998 | Young | A47K 3/008 4/613 |
| 8,230,535 | B2 | 7/2012 | Kik et al. | |
| 8,918,926 | B1 * | 12/2014 | Herring | E03F 5/0408 4/613 |
| 9,107,545 | B1 | 8/2015 | Herring | |
| 9,408,501 | B2 | 8/2016 | Erlebach | |
| 9,775,472 | B1 | 10/2017 | Herring | |
| 10,779,688 | B1 | 9/2020 | Herring | |
| 2015/0128340 | A1 * | 5/2015 | Davis, Jr. | A47K 3/40 4/613 |
| 2020/0229654 | A1 | 7/2020 | Paradis | |

FOREIGN PATENT DOCUMENTS

| | | | |
|---|---|---|---|
| CA | 2089680 | C | 5/2002 |
| CA | 2689796 | C | 8/2016 |
| EP | 2 206 456 | A2 | 7/2010 |
| KR | 20200091360 | A | 7/2020 |

* cited by examiner

*Primary Examiner* — Lauren A Crane
(74) *Attorney, Agent, or Firm* — Foley & Lardner LLP

(57) ABSTRACT

A shower system for use in a shower environment includes a pre-fabricated tileable receptor configured for installing in the shower environment to provide a base for installing a tiled surface on top of the tileable receptor. The tileable receptor includes a drain area and a sloped portion configured to direct a liquid toward the drain area. The tileable receptor is made of a layered material including a structural layer and a membrane layer. The structural layer is configured to maintain a shape of the sloped portion. The membrane layer is supported by the structural layer and includes a surface texture. The membrane layer facilitates a mechanical bond with a tile adhesive material.

20 Claims, 9 Drawing Sheets

TILEABLE RECEPTOR

CROSS-REFERENCE TO RELATED PATENT APPLICATION

This application claims the benefit of and priority to U.S. Provisional Application No. 63/231,935, filed on Aug. 11, 2021, the entire disclosure of which is incorporated by reference herein.

BACKGROUND

The present disclosure relates generally to receptor devices. More specifically, the present disclosure relates to receptor devices for bathing or washing applications.

Receptors may be used in various commercial and domestic environments such as a shower, bath, or other locations where water is to be collected and directed into at least one drain. Typical tiled bathing spaces (e.g., a bathing area, a shower, etc.) and equipment (e.g., shower bases require a carefully prepared sloped and waterproofed mortar base on which tile may be applied. Creating a sloped and waterproofed base may be time-consuming and difficult for an installer (e.g., an average or first-time installer) to successfully execute. Improperly sloped and/or improperly waterproofed bases may cause damage to property and structures surrounding the shower base, and often facilitate undesirable decay, rotting, bacterial growth, and/or fungal growth, ultimately leading to a poor user experience. Additionally, conventional receptors are often difficult and expensive to change and/or replace.

SUMMARY

At least one embodiment relates to a shower system for use in a shower environment includes a pre-fabricated tileable receptor. The tileable receptor is configured for installing in the shower environment to provide a base for installing a tiled surface on top of the tileable receptor. The tileable receptor includes a drain area and a sloped portion configured to direct a liquid toward the drain area. The tileable receptor is made of a layered material including a structural layer and a membrane layer. The structural layer is configured to maintain a shape of the sloped portion. The membrane layer is supported by the structural layer and includes a surface texture. The membrane layer facilitates a mechanical bond with a tile adhesive material.

In some embodiments, the layered material further includes a polymeric layer between the structural layer and the membrane layer. In some embodiments, the structural layer includes a fiber reinforced composite material.

In some embodiments, the membrane layer is thermoformed to the polymeric layer.

In some embodiments, the membrane layer includes a fibrous material having a higher melting point or glass transition temperature than a melting point or glass transition temperature of the polymeric layer.

In some embodiments, the polymeric layer includes acrylonitrile butadiene styrene, and the polymeric layer is water impermeable.

In some embodiments, a thickness of the polymeric layer is less than a thickness of the structural layer.

In some embodiments, the layered material further includes a barrier layer between the structural layer and the polymeric layer. In some embodiments, the barrier layer is made of a heat formable acrylic material.

In some embodiments, the structural layer is made of at least one of a fiberglass reinforced material or an oriented strand board material.

In some embodiments, the tileable receptor further includes a flange defined on a perimeter portion of the tileable receptor. In some embodiments, the flange is configured to be coupled to a surface of the shower environment.

In some embodiments, the tileable receptor includes one or more side walls extending upward from a perimeter portion of the sloped portion. In some embodiments, the one or more sidewalls are configured to contain the liquid within the perimeter portion.

In some embodiments, the sloped portion includes a conical portion around the drain area. In some embodiments, the conical portion has a uniform pitch.

Another embodiment relates to a pre-fabricated tileable receptor for use in a shower environment to provide a base for installing a tiled surface on top of the tileable receptor. The tileable receptor includes a drain area, a sloped portion, and a layered material. The sloped portion is configured to direct liquid toward the drain area. The layered material includes a structural layer, a polymeric layer, and a membrane layer. The structural layer is made of a fiber reinforced material. The polymeric layer is configured to be water impermeable. The membrane layer includes a surface texture configured to promote a mechanical bond between the membrane layer and a tile adhesive material.

In some embodiments, the membrane layer comprises a fibrous material having a higher melting point or glass transition temperature than a melting point or glass transition temperature of the material of the polymeric layer.

In some embodiments, the polymeric layer comprises acrylonitrile butadiene styrene.

In some embodiments, a thickness of the polymeric layer is less than a thickness of the structural layer.

In some embodiments, the layered material includes a barrier layer between the structural layer and the polymeric layer, and the barrier layer is made of a heat formable acrylic material. In some embodiments, the heat formable acrylic material is configured to prevent chemical interactions between the structural layer and the polymeric layer.

Another embodiment relates to a method of installing a tiled surface in a shower environment. The method includes obtaining a pre-fabricated tileable receptor. The tileable receptor defines a drain area and a sloped portion. The tileable receptor is made of a layered material including a structural layer and a membrane layer. The membrane layer has a surface texture that promotes mechanical bonding between the membrane layer and a tile adhesive. The method includes coupling the tileable receptor to the shower environment to provide a base for installing a tiled surface on top of the tileable receptor. The method includes applying a tile adhesive to the surface texture of the membrane layer. The method includes applying a plurality of tiles to the tile adhesive layer to firm the tiled surface on top of the tileable receptor.

In some embodiments, the structural layer is a fiber-reinforced material. In some embodiments, the layered material comprises a polymeric layer. In some embodiments, the layered material is formed by a heat bonding process.

In some embodiments, the sloped portion defines a receptor profile, and the receptor profile is different than a surface of the shower environment.

In some embodiments, the polymeric layer is a water impermeable material. In some embodiments, the membrane layer includes a fabric material that is heat bonded to the polymeric layer.

This summary is illustrative only and should not be regarded as limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting. The various concepts introduced above and discussed in greater detail below may be implemented in any number of ways, as the described concepts are not limited to any particular manner of implementation. Examples of specific implementations and applications are provided primarily for illustrative purposes.

Referring generally to the figures, described herein are systems and methods for a tileable receptor enabling an efficient and reliable installation and implementation of a receptor having a tiled surface. A tiled surface can provide various aesthetic and functional benefits, but is often a cost prohibitive option when compared to other options having different surface compositions. Often, a large component of the cost associated with a tiled surface is the preparation of the surface to which the tiled surface is to be applied. For example, preparation of an appropriate surface topography (e.g., profile, slope(s)), waterproofing, and surface texture for an application of a tiled surface is time consuming and difficult to accomplish, especially for inexperienced installers. Advantageously, the systems and methods described herein provide for a receptor that facilitates an efficient and simple installation of a tiled surface and receptor.

Figure 1:
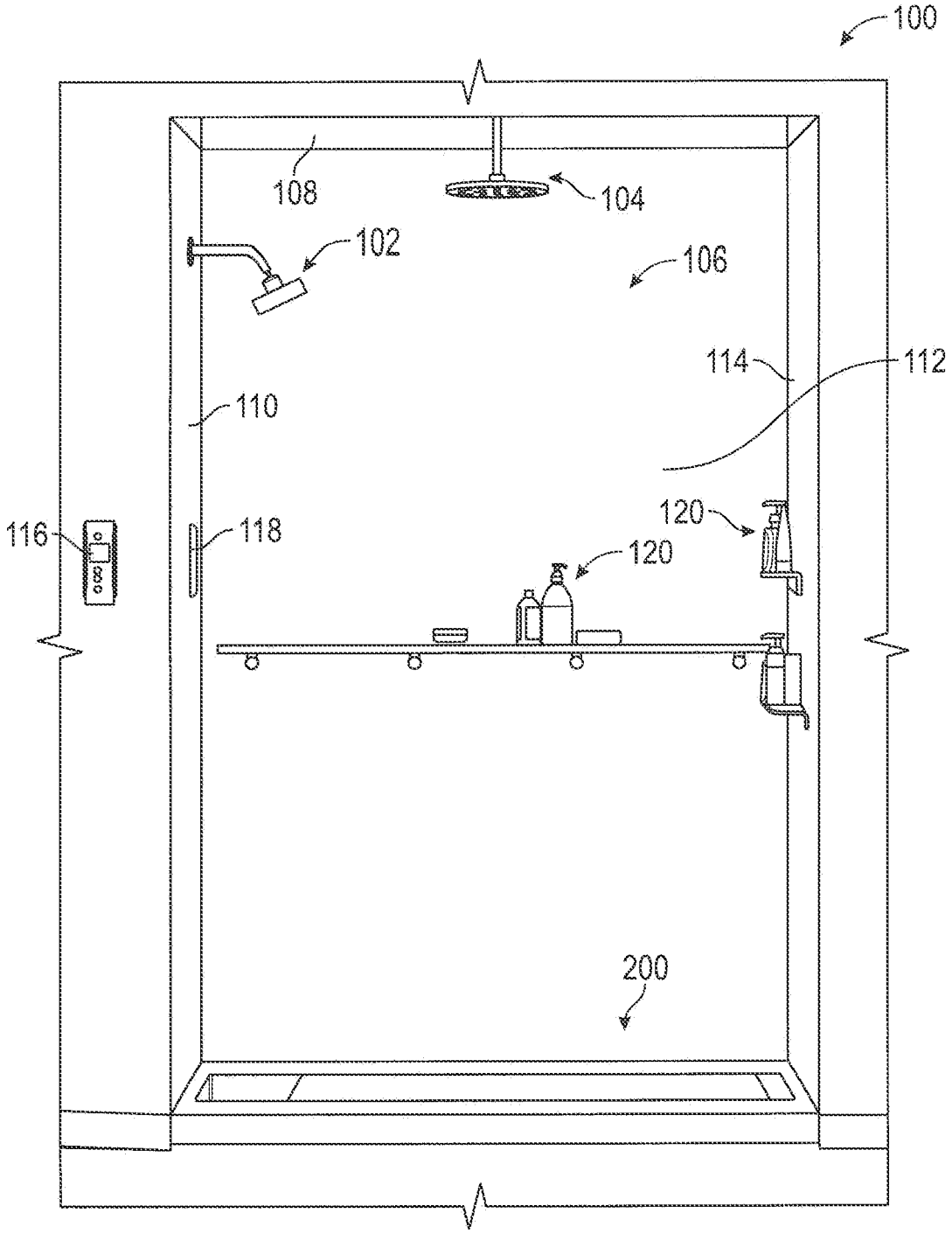
FIG. 1 is a shower stall having a tileable receptor, according to some embodiments.

Referring to FIG. 1, a wet location (e.g., a bathing area, a shower stall, a shower alcove, a shower recess, a shower room, a shower environment, etc.) is shown as shower 100. Shower 100 may be configured to allow a user to bathe within the shower 100, and may include a shower system. The shower system may include some or all of the elements of the shower 100. In some embodiments, the shower 100 includes fluid supply devices, shown as showerhead 102 and a rainhead 104 configured to direct and output water into shower area 106. In some embodiments, shower area 106 is sufficiently large to accommodate one or more users. As shown, shower area 106 is defined as the space within ceiling 108, showerhead wall 110, side wall 112, rear wall 114, and a tileable receptor (e.g., a pre-fabricated tileable receptor, tile-ready shower receptor, tile-ready shower receptor, tileable shower tray, tileable bathing receptor, tileable shower insert, tile-ready bathing enclosure insert, tileable shower base, tile-ready fluid collector, tile-ready shower floor, tile-ready basin, etc.), shown as tileable shower receptor 200. As shown, shower area 106 is open on a side. In some embodiments, shower area 106 is selectively enclosed by a user access wall (e.g., a shower door, a shower curtain, etc.). Shower 100 is further shown to include exterior shower controller 116 and interior shower controller 118. In some embodiments, exterior shower controller 116 and interior shower controller 118 may be configured to allow a user to adjust the water output (e.g., temperature, flow rate, etc.) from showerhead 102 and/or rainhead 104, and other shower area 106 features (e.g., lighting, music, steam, ambient air temperature, etc.). As shown, shower area 106 further includes user cleaning products 120. In some embodiments, tileable shower receptor 200 is configured to receive and direct water output from showerhead 102 and rainhead 104 into one or more drains. In some embodiments, tileable shower receptor 200 is configured to also receive cleaning products 120 after being used by the user within the shower area 106.

Figure 2:
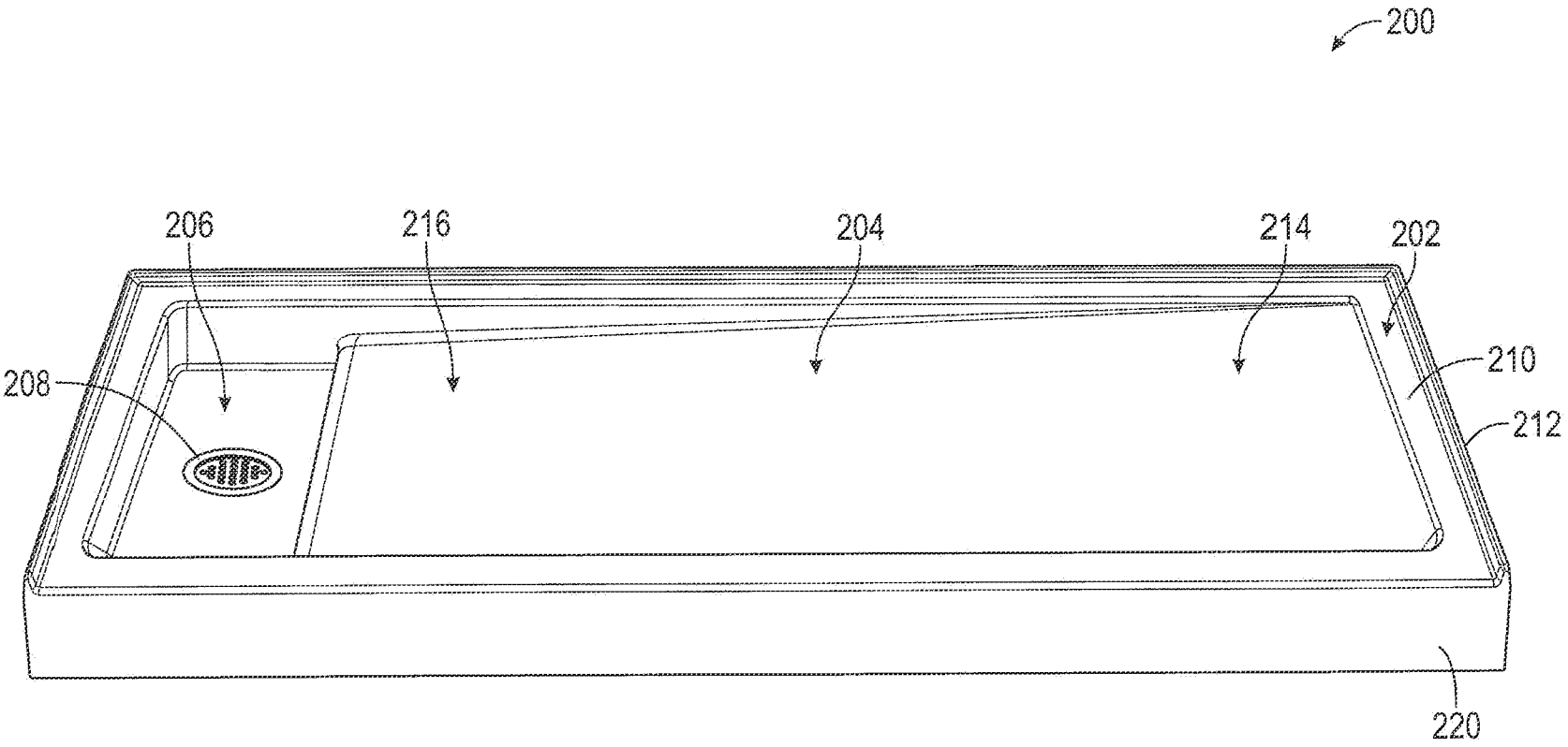
FIG. 2 is a perspective view of the tileable shower receptor of FIG. 1, according to some embodiments.

Referring now to FIG. 2, tileable shower receptor 200 is shown as a left offset drain receptor. In some embodiments, tileable shower receptor 200 is a right offset drain receptor, corner drain receptor, center drain receptor, multi drain receptor, etc. As shown, tileable shower receptor 200 includes perimeter portion 202, sloped portion 204, and drain area 206. In some embodiments, drain area 206 includes a drain 208. As shown, perimeter portion 202 includes plateau portion 210 and raised edge portion 212. In some embodiments, raised edge portion 212 facilitates a water tight seal between showerhead wall 110, side wall 112, and rear wall 114. For example, raised edge portion 212 may facilitate a water tight seal between showerhead wall 110, side wall 112, and rear wall 114 by providing a surface for a bead of sealant (e.g., caulk, silicone, etc.) to be applied. In some embodiments, raised edge portion 212 extends around a portion of or the entirety of the perimeter portion 202 of the tileable shower receptor 200. In some embodiments, perimeter portion 202 does not include raised edge portion 212. In some embodiments, plateau portion 210 is substantially horizontal to allow a user to place one or more items (e.g., cleaning products 120) on the tileable shower receptor 200 without the items rolling or sliding in the sloping direction of sloped portion 204. In some embodiments, the sloped portion 204 slopes toward drain area 206 to direct water and other fluids toward the drain 208. As shown, the sloped portion 204 is substantially planar and includes an upper portion 214 and a lower portion 216. In some embodiments, sloped portion 204 is curved, or includes one or more sloped or horizontal steps. In some embodiments, sloped portion 204 includes one or more less sloped (e.g., horizontal, level) portions for a user to stand on.

In some embodiments, drain area 206 includes a basin that collects water that runs off sloped portion 204 and ultimately directs water into drain 208. In some embodiments, the edges between the features (e.g., sloped portion 204, drain area 206, perimeter portion 202, etc.), of tileable shower receptor 200 are rounded or chamfered to prevent a user from being injured. In some embodiments, the rounded or chamfered edges may allow an installer of the tileable receptor to use larger radius rounded or curved tiles to cover the edges of the tileable shower receptor 200. In some embodiments, the edges between the features of tileable shower receptor 200 are not rounded or chamfered to facilitate using flat tiles at the edges of the features of tileable shower receptor 200.

In some embodiments, tileable shower receptor 200 includes outer sidewalls 220. Outer sidewalls 220 are continuous around the outermost edge of the tileable shower receptor 200, according to some embodiments. In some embodiments, outer sidewalls 220 are discontinuous around the outermost edge of the tileable shower receptor 200. In some embodiments, outer sidewalls 220 are configured to support the tileable shower receptor 200. For example, outer sidewalls 220 may contact the floor underneath shower 100 (e.g., a subfloor) to support a user standing on various portions of the tileable shower receptor 200. In some embodiments, sidewalls 220 are sufficiently tall to allow the height difference between upper portion 214 and lower portion 216 to correspond to a recommended slope (e.g., a minimum of 4% fall, etc.) without requiring modification of the floor underneath shower 100 (e.g., a subfloor). In such embodiments, the preformed slope portion 204 may enable a user to rely on the slope provided by the sloped portion 204 without modification to the floor underneath shower 100 to achieve a suitable slope for the floor of a shower 100. In this way, the tileable shower receptor 200 having a preformed sloped portion 204 may reduce installation time and installation complexity. In other words, sidewalls 220 may elevate the upper portion 214 and lower portion 216 from the floor below shower 100 to prevent an installer from needing to slope the floor underneath shower 100, and may allow an installer to more rapidly and successfully complete a tile installation project.

Figure 3:
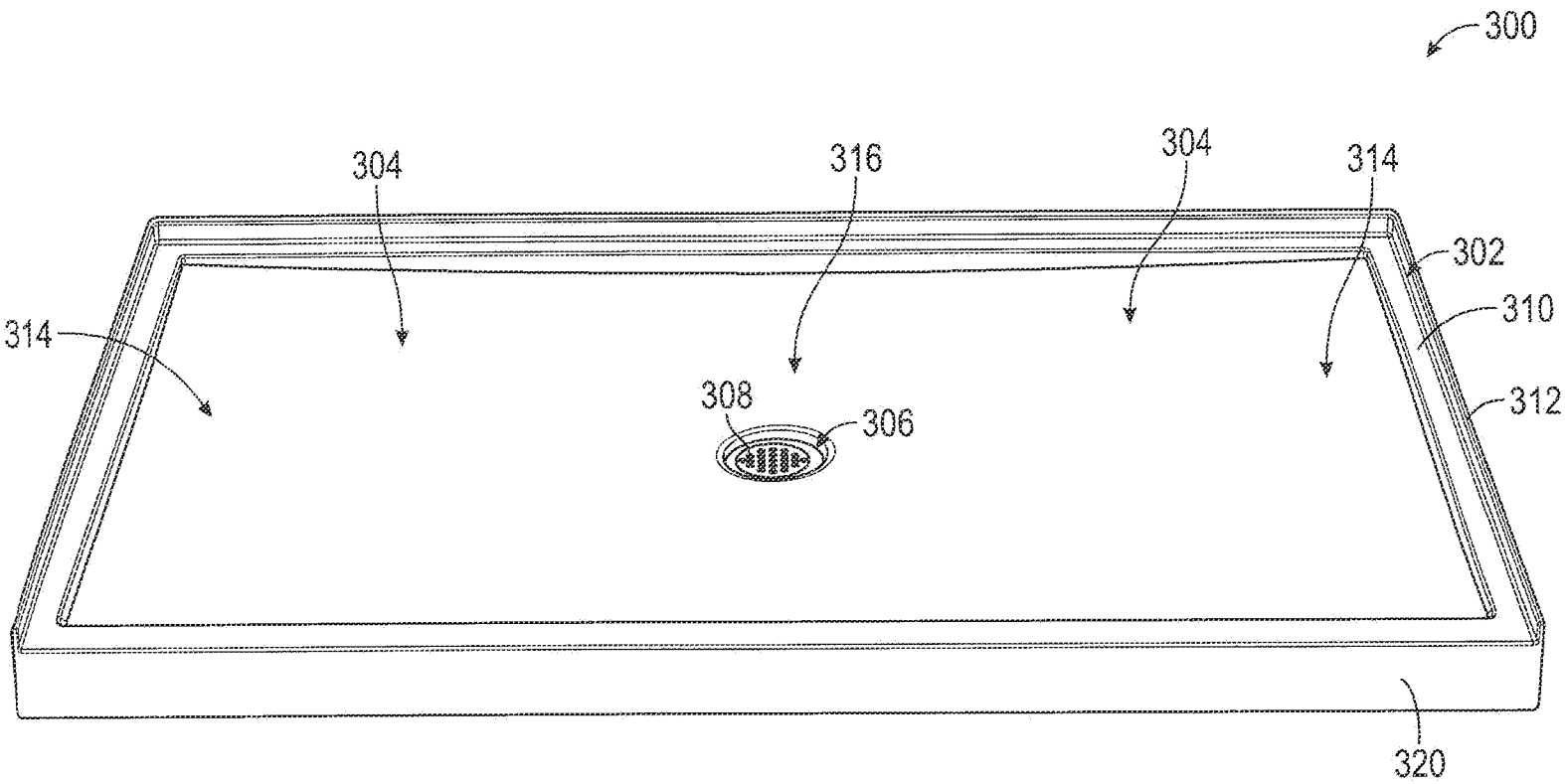
FIG. 3 is a perspective view of a tileable shower receptor, according to some embodiments.

Referring now to FIG. 3, a tileable receptor 300 is shown, according to some embodiments. Tileable receptor 300 may be similar to or different than tileable shower receptor 200. Tileable receptor 300 may include one or more of the features and/or functionality described with respect to tileable shower receptor 200. For example, tileable receptor 300 may include a perimeter portion 302 similar to perimeter portion 202. In some embodiments, tileable receptor 300 may be a pre-fabricated unitary body for installation in shower 100. For example, the tileable receptor 300 may be fabricated prior to being installed in shower 100 and may be obtained by an installer or user from a provider (e.g., a retailer, a fabricator, etc.). The tileable receptor 300 can provide a base for installing a tiled surface (e.g., tile adhesive and multiple tiles) on one or more surfaces of the tileable receptor 300. The tileable receptor 300 may facilitate an installer directly applying tile adhesive as part of the tile installation process without additional surface preparation upon installation of the tileable receptor 300 in a suitable environment (e.g., shower 100).

In some embodiments, tileable receptor 300 is in a center drain configuration and includes perimeter portion 302, sloped portion 304, and drain area 306. Perimeter portion 302 includes a plateau portion 310 and raised edge portion 312, according to some embodiments. In some embodiments, perimeter portion 302 is simplified. For example, perimeter portion 302 may not include raised edge portion 312, which may facilitate a user tiling to the outermost edge of perimeter portion 302. In such example, a user may more easily create an uninterrupted transition between tiling on walls 110, 112, 114 and tiling on tileable shower receptor 200.

In some embodiments, sloped portion 304 is similar to sloped portion 204 and has an upper portion 314 and a lower portion 316, which direct water toward drain area 306. In some embodiments, drain area 306 includes drain 308. In some embodiments, tileable receptor 300 includes more than one drain 308. In some embodiments, sloped portion 304 may be one or a combination of curved, planar, or stepped geometries. In some embodiments, sloped portion 304 is substantially planar between upper portion 314 and lower portion 316 to facilitate a user creating a substantially planar tiled surface. As shown, drain area 306 includes a drain 308 in a recessed portion of drain area 306. In some embodiments, the drain 308 is recessed relative to lower portion 316 to allow pooling of water near drain 308 to accommodate transient irregular flow rates or flow rates that exceed the drainage rate. In some embodiments, the sloped portion 304 includes a conical shaped portion having a uniform pitch around the drain 308.

Figure 4:
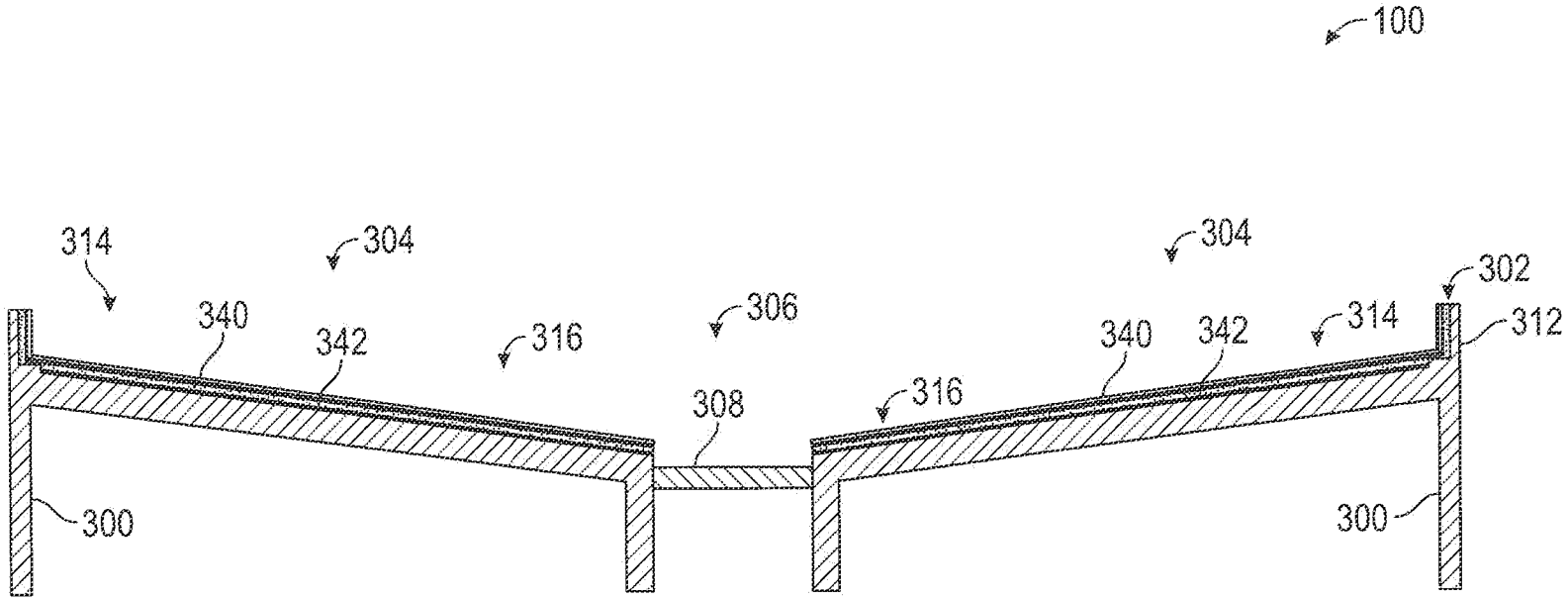
FIG. 4 is a section view of the tileable shower receptor of FIG. 4, according to some embodiments.
Figure 5:
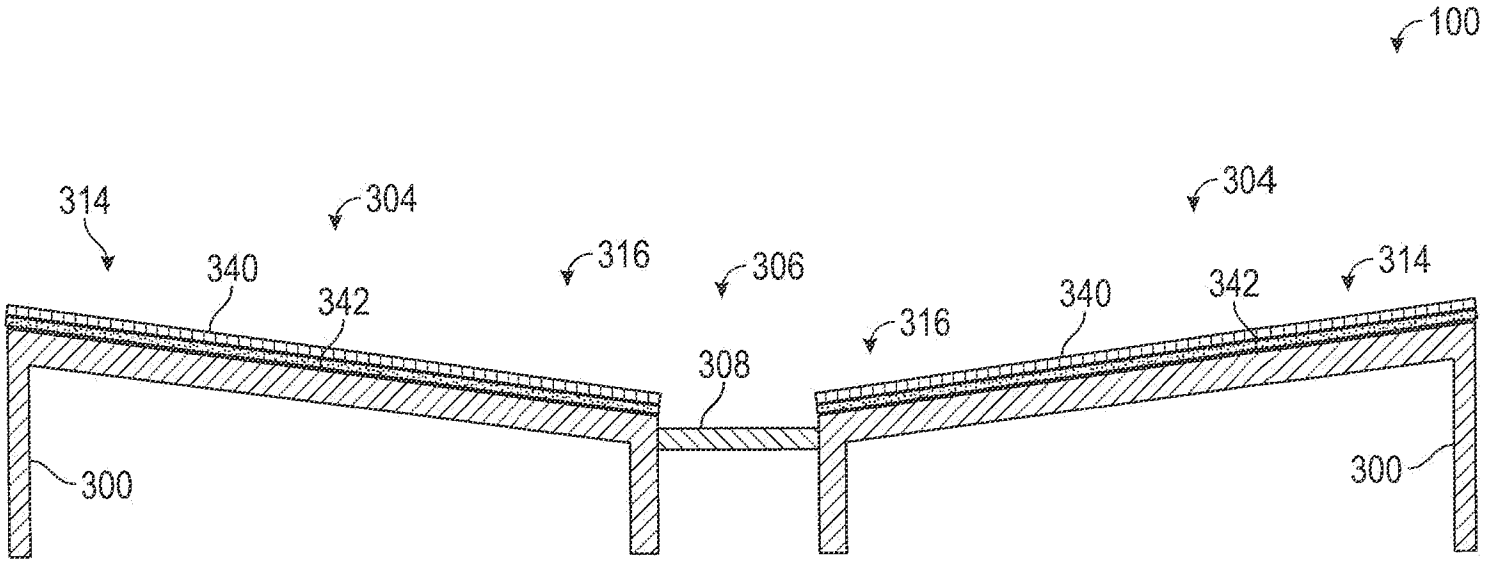
FIG. 5 is a section view of the tileable shower receptor of FIG. 4, according to some embodiments.

Referring now to FIGS. 4 and 5, a cross section of tileable receptor 300 is shown, according to some embodiments. As shown, sloped portion 304 includes a tile adhesive layer (e.g., thinset, mortar, epoxy tile mortar, etc.), shown as thinset layer 342, and a tiles, shown as tile layer 340 (e.g., porcelain tiles, ceramic tiles, marble tiles, mosaic tiles, limestone tiles, slate tiles, vinyl tiles, pebble tiles, glass tiles, recycled tiles, coin tiles, etc.) installed by an installer of the tileable receptor 300. Referring specifically to FIG. 4, tileable receptor 300 includes a perimeter portion 302 (e.g., lip, rim, flange, etc.). In some embodiments, an installer may tile over the perimeter portion 302 (see, e.g., FIG. 4). In some embodiments, an installer may decide to not tile over a perimeter portion 302. In some embodiments, the perimeter portion 302 may be optionally tiled underneath a layer of a wall defining a space above the tileable receptor 300. For example, the perimeter portion 302 may be positioned behind a junction between wall tiles (e.g., tiles applied to surfaces of the walls of the shower 100) and tiles applied to the surface(s) of the tileable receptor 300. Referring to FIG. 5, the tileable receptor 300 does not include a perimeter portion 302. In some embodiments, sloped portion 304 extends all the way to the outermost edge of the tileable receptor 300. In some embodiments, when the tileable receptor 300 is installed, the underside of the tileable receptor 300 defines a void (e.g., space, gap, etc.) between the supporting surface below the tileable receptor 300 (e.g., a subfloor). In some embodiments, the tileable receptor 300 is installed on (e.g., supported by, secured to, coupled to, etc.) a substantially planar (e.g., flat) supporting surface.

Figure 6:
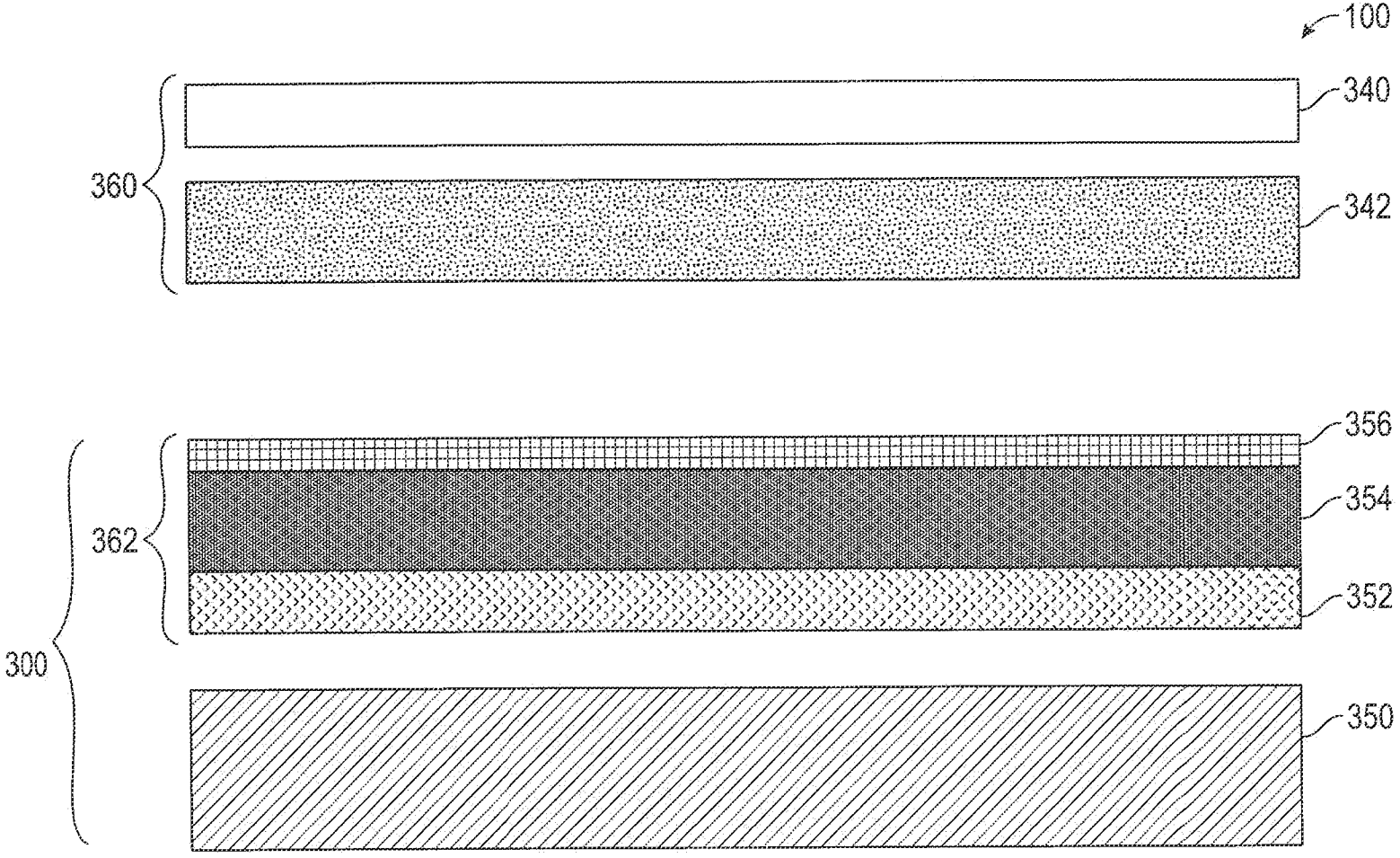
FIG. 6 is an exploded detail section view of the tileable shower receptors of FIGS. 1-5 showing example layers of the tileable shower receptor, according to some embodiments.
Figure 7:
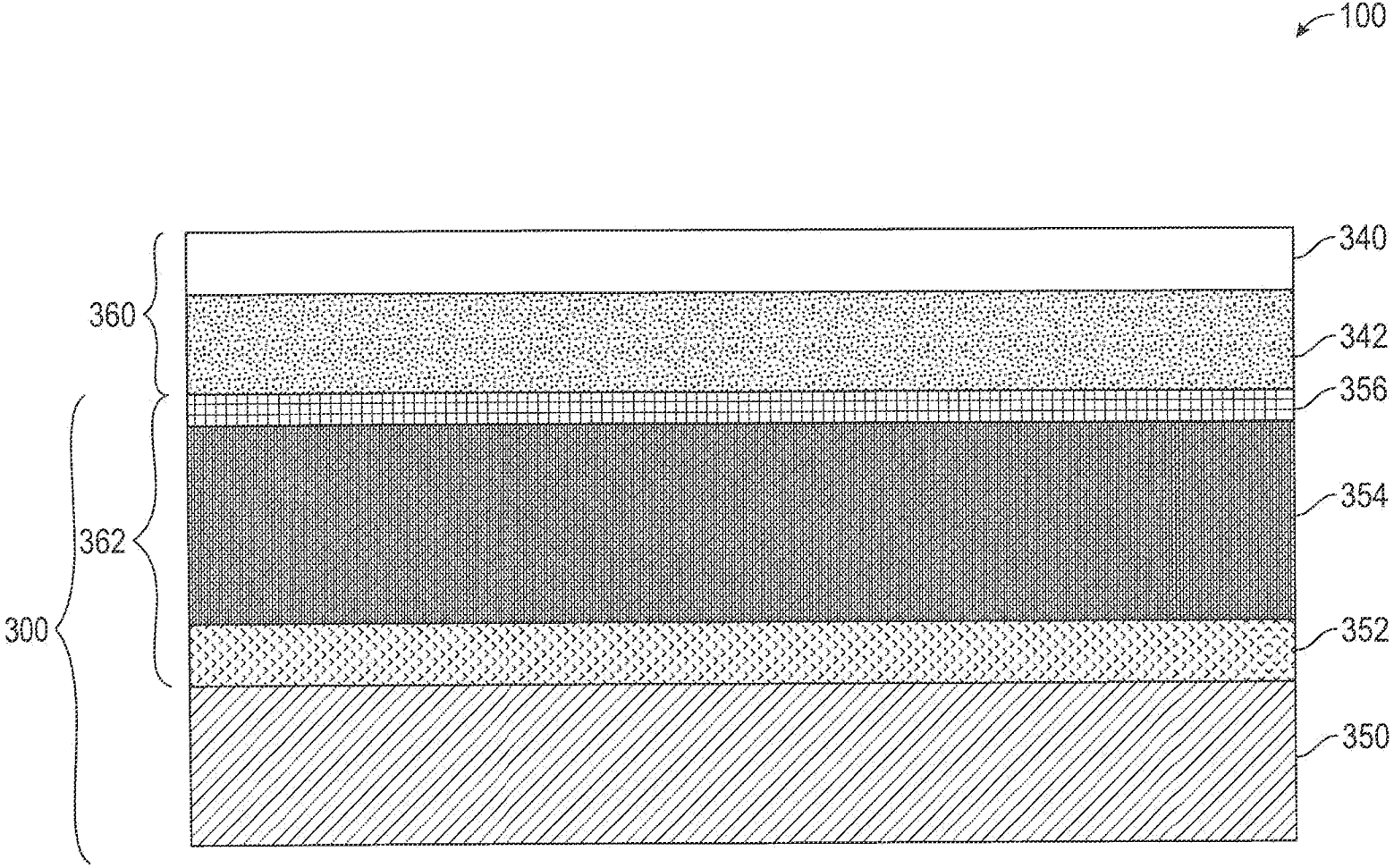
FIG. 7 is a detail section view of the tileable shower receptors of FIGS. 1-5 showing example layers of the tileable shower receptor, according to some embodiments.

Referring now to FIGS. 6 and 7, a cross section of the tileable receptor 300 is shown in greater detail. As shown, tileable receptor 300 includes a structural layer (e.g., support layer, base layer, etc.) 350, a barrier layer (e.g., a first coupling layer, screen layer, etc.) 352, a polymeric layer (e.g., melt layer, etc.) 354, and a membrane layer (e.g., fabric layer, second coupling layer, etc.) 356. In some embodiments, structural layer 350 may be a fiber-reinforced composite (e.g., a fiberglass reinforced polymer, a fiberglass reinforced plastic, etc.), or other supportive composite material such as oriented strand board (OSB) or particle board. In some embodiments, the fiber of the fiber reinforced composite is at least one of a glass, carbon, aramid, basalt, flax, hemp, paper, wood, or other suitable fiber. In some embodiments, the fiber reinforced composite includes a polymer such as an epoxy, vinyl ester, or polyester thermosetting plastic. In some embodiments, the fiber is glass and the polymer is a resin. In such embodiments, the fiber and polymer of the structural layer 350 may be selected to prevent deformation and deflection of the sloped portion 304. In some embodiments, the structural layer 350 is a fiber reinforced composite having a high strength with a low material weight and cost (as compared to other materials like concrete, metals, etc.). In some embodiments, structural layer 350 has a thickness and reinforcement that facilitates the tileable receptor 300 supporting the weight of a user standing on the tileable receptor 300 with little or no deformation of the tileable receptor 300. For example, the structural layer 350 may prevent the tileable receptor 300 from flexing, such that a tiled surface installed on the tileable receptor is not at risk of fracturing and/or cracking due to a flexing force being applied to the tiled surface. In this way, the tileable receptor 300 may facilitate tiling while having a form factor similar to a conventional shower insert.

In some embodiments, barrier layer 352 is a material with a high chemical resistance and high heat forming ability. For example, in some embodiments, barrier layer 352 is acrylic. In some embodiments, barrier layer 352 is located between structural layer 350 and polymeric layer 354 to prevent chemical interactions between the polymer of the fiber reinforced composite of structural layer 350 with the polymeric layer 354. In some embodiments, barrier layer 352 may be thermoformed or heat-bonded to the structural layer 350 and the polymeric layer 354.

In some embodiments, polymeric layer 354 is a thermoplastic with low water absorptivity. In some embodiments, polymeric layer 354 is at least one of a polytetrafluoroethylene (PTFE) polymer, polyether ether ketone (PEEK) polymer, polyenylene sulfide (PPS) polymer, polysulfone (PSU) polymer, polyphenylsulfone (PPSU) polymer, polyetherimide (PEI) polymer, polyvinylidene fluoride (PVDF) polymer, polyethylene terephthalate (PET) polymer, polyphethelene ether (PPE) polymer, polypropylene (PP) polymer, polyethylene (PE) polymer, acetal polyoxymethylene (POM) polymer, polycarbonate (PC) polymer, and acrylonitrile butadiene styrene (ABS) polymer. In an exemplary embodiment, polymeric layer 354 is an ABS polymer. In some embodiments, polymeric layer 354 is an ABS polymer due to its comparatively low cost, ease of bonding, good machinability, and relative abundance in the market. In some embodiments, barrier layer 352 is acrylic to protect the ABS layer from esters, ketones, chloroform, aromatic hydrocarbons, sulfuric acids, and/or nitritic acids that may be present in the resin, epoxy, or other compounds used in the fiber reinforced composite of the structural layer 350, while still facilitating heat-bonding between the layers.

In some embodiments, polymeric layer 354 is a thin, nonstructural (e.g., non-weight supporting) layer of polymeric material. In some embodiments, the polymeric layer 354 is sufficiently thick to provide a continuous water impermeable surface throughout the tileable receptor 300, and facilitate coupling with at least the membrane layer 356. For example, polymeric layer 354 may be sufficiently thick to not tear, puncture, rip, or otherwise fail during a heat-bonding process. While the tiled surface can prevent some or all of a liquid from passing through the material of the tileable receptor 300, the polymeric layer may provide a reliable waterproofing of the tileable receptor 300 (independent of the tile layer) and may thereby reduce the time and effort required by an installer to perfect the waterproofing of the tiled surface. Additionally, the polymeric layer 354 can prevent liquid from accumulating in locations underneath or within the material underlying the polymeric layer 354 that might otherwise be damaged or affected (e.g., by water damage, mold growth, etc.) due to an accumulated liquid. In some embodiments, the polymeric layer 354 has a lesser thickness than structural layer 350. It is worth noting that the layers shown in FIGS. 6 and 7 (e.g., structural layer 350, barrier layer 352, polymeric layer 354, membrane layer 356, etc.) may have different proportions than those shown in FIGS. 6 and 7.

In some embodiments, membrane layer 356 is a fibrous and permeable material. For example, membrane layer 356 may be a fabric (e.g., cotton, linen, Tyvek, etc.) or a polymeric non-woven fabric (e.g., low-density PP fabric, high-density PP fabric, low-density PE fabric, high-density PE fabric, etc.). The membrane layer 356 may be glued to or thermoformed to (e.g., by heat-bonding, by thermal bonding, by melt bonding) the polymeric layer 354. In some embodiments, membrane layer 356 is thermoformed to polymeric layer 354 and has a wavy or corrugated texture. In some embodiments, membrane layer 356 is a fibrous and pliable material that has a higher melting point or glass transition temperature than the material used in polymeric layer 354. In such embodiments, membrane layer 356 is able to retain independent fiber structure during a heat-bonding process with the polymeric layer 354. In some embodiments, the glass transition point of the membrane layer 356 is lower than the glass transition temperature of polymeric layer 354. In an exemplary embodiment, a non-woven polyester (e.g., PET) membrane is used, having a glass transition temperature of approximately 158° F. In some embodiments, a composite non-woven material is used (e.g., a polyester with natural or synthetic fibers added), which may increase the ability of the membrane layer 356 to maintain a desirable texture (e.g., a rough, ridged, fuzzy, etc.) during and after heat-bonding with the polymeric layer 354. For example, cotton or select other natural fibers typically do not melt or deform at or near the glass transition temperature of common polyesters, which may advantageously cause a polyester membrane layer 356 to maintain a discretely fibrous texture on the surface of polymeric layer 354 after thermoforming. In some embodiments, a non-woven polyester membrane layer 356 is desirable for its cost effectiveness, accessibility, and ability to form pliable sheets of material having a random interlaced fiber structure that facilitates improved mechanical bonding when applied to a surface.

Still referring to FIG. 7, as discussed above, the material and form of material (e.g., woven fabric, non-woven fabric, etc.) used in membrane layer 356 may be selected and implemented to facilitate adhesion of a tile adhesion material (e.g., thinset, mortar, etc.). For example, the mortar used to adhere tiles to the tileable receptor 300 may not be capable of forming a reliable bond directly with polymeric layer 354 (e.g., an ABS layer) without membrane layer 356. In some embodiments, membrane layer 356 includes gaps and spaces between fibers of the membrane layer 356 to allow the thinset layer 342 to penetrate the membrane layer 356, ultimately providing a more solid bond between polymeric layer 354 and thinset layer 342.

In some embodiments, the membrane layer 356 may be formed of a plurality of discrete components, such as string, fibers, cloth, and the like. For example, during manufacturing of the membrane layer 356 and the polymeric layer 354, the polymeric layer 354 may be heated until molten, and short pieces of string may be sprinkled into the molten polymeric layer 354 to provide a coupling surface for the thinset layer 342. While string is illustrated as a potential material, it should be understood that there are many materials that could provide the desired texture in the polymeric layer 354, such as pieces of scrap cloth, string, carpet padding, foam, sawdust, wood, and the like. In some embodiments, the discrete components to be provided to the polymeric layer 354 may be selected to have a flash point below the glass transition temperature of the polymeric layer 354. In some embodiments, membrane layer 356 is a "fuzzy" membrane formed as a combination of the material of the polymeric layer 354 and an added or intermixed material. In some embodiments, membrane layer 356 is a fuzzy material adhered to the polymeric layer 354. In some embodiments, membrane layer 356 facilitates a reliable mechanical bond (e.g., an engagement with an adhesive promoting surface) with any thinset or adhesive that is used for firming (e.g., adhering, bonding, securing, etc.) tile layer 340 to the tileable receptor 300.

In some embodiments, membrane layer 356 may be heat-bonded to polymeric layer 354 by heating the upper surface of polymeric layer 354 to a temperature that causes the thermoplastic (e.g., thermosoftening plastic) to become pliable or moldable, and pressing (e.g., by a mechanical press) the membrane layer 356 into the heated (i.e., softened) thermoplastic of polymeric layer 354. For example, the surface of the polymeric layer 354, or the entire polymeric layer 354, may be heated to its glass transition temperature to cause the surface of, or the entirety of, the polymeric layer 354 to be in a viscous or rubbery state that allows membrane layer 356 to be pressed into and secured by the polymeric layer 354 upon cooling. In some embodiments, the polymeric layer 354 is ABS, and the glass transition temperature is approximately 221° F. In an exemplary embodiment, the surface of the ABS of the polymeric layer 354 may be heated to 221° F. rapidly to prevent the polymeric layer 354 from deforming or becoming entirely pliable and moldable.

In some embodiments, polymeric layer 354, membrane layer 356, and barrier layer 352 are heat-bonded into a sheet of material that can be applied to walls or other planar surfaces (e.g., ceiling 108, showerhead wall 110, side wall 112, and rear wall 114). In some embodiments, polymeric layer 354, membrane layer 356, and barrier layer 352 are heat-bonded and simultaneously or subsequently formed into a receptor shape (e.g., the receptor shapes shown in FIGS. 2-5). As described above, in some embodiments, membrane layer 356 is permeable, with polymeric layer 354 (e.g., an ABS polymeric layer) functioning as a sealing or waterproof layer that prevents water or other liquid solutions from penetrating the tileable receptor 300. In some embodiments, barrier layer 352 contributes to the prevention of water and/or liquid solutions penetrating the tileable receptor 300.

Still referring to FIGS. 6 and 7, tile layer 340 and thinset layer 342 are shown to be part of onsite installation layer 360. In some embodiments, a user or installer may purchase or acquire tileable receptor 300 for installation in a suitable location and subsequently place a thinset layer 342 on the surfaces to be tiled (e.g., the top surfaces, the visible surfaces, etc.). of the tileable receptor 300. The user may then apply tiles to the thinset layer 342 to form tile layer 340. In an exemplary embodiment, the thinset layer 342 partially or fully seeps into the membrane layer 356 before curing (e.g., hardening, solidifying, etc.) to facilitate a strong and reliable bond between the thinset layer 342 and membrane layer 356.

In some embodiments, membrane layer 356, polymeric layer 354, and barrier layer 352 are formed and supplied as a layered sheet 362. In some embodiments, membrane layer 356, polymeric layer 354, and barrier layer 352 are coupled together by heat-bonding, adhesive, or other coupling techniques. In some embodiments, the polymeric layer 354 may be a composite polymeric material that has the components of membrane layer 356 scattered throughout. For example, the polymeric layer 354 may include a polymer formulated with fibrous or structured constituents (e.g., woven or non-woven fibers, filaments, wires, sawdust, cloth, textiles, fabrics, mesh, netting, etc.) which provides a rough and textured surface suitable for adhering thinset layer 342. In some embodiments, the filaments and other constituents are mixed into the polymer matrix. In some embodiments, the constituents are not mixed into the polymer matrix to ensure a continuous layer of polymer material that is water impermeable (e.g., no holes or pockets that may penetrate the polymeric layer). For example, if wood fibers or tubular fibrous structures are mixed into a thin sheet of polymer, the fibers may create pockets or passages for water to travel through the polymeric layer 354.

In some embodiments, the user places the tileable receptor 300 in a suitable area (e.g., shower 100). The user may then install the necessary hardware (e.g., drains, fasteners, sealant, etc.) and secure (e.g., fasten, glue, etc.) the tileable receptor 300 to the area. The user may then apply a layer of mortar (e.g., thinset layer 342) to the membrane layer 356 of the tileable receptor 300, and top the thinset layer 342 with a tile layer 340 as desired by the user.

In some embodiments, the tileable receptor 300 may optionally include additional layers (e.g., a sound deadening material layer, an additional polymeric layer 354 below the structural layer 350, etc.) that support at least one function of the tileable receptor 300.

Figure 8:
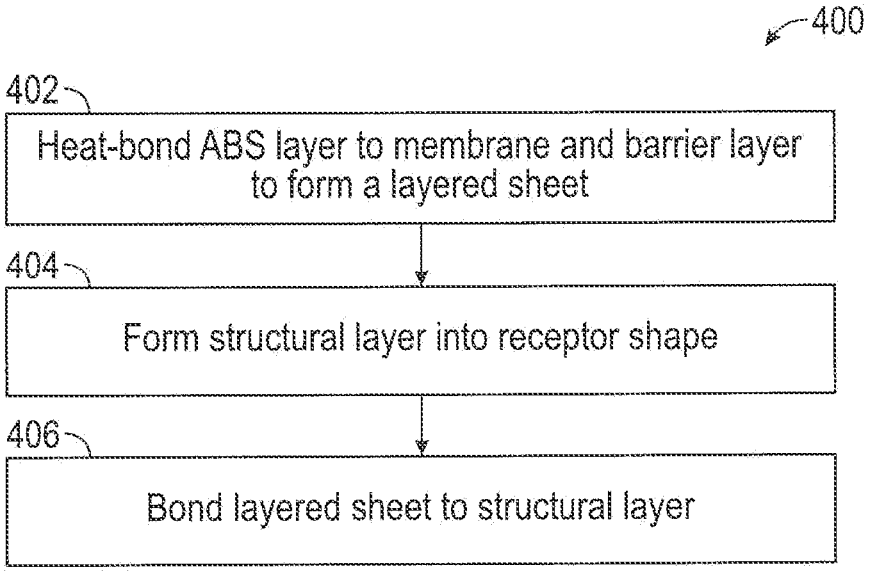
FIG. 8 is a flowchart of fabricating a tileable receptor, according to some embodiments.

Referring now to FIG. 8, a flow diagram of a process 400 for fabricating a tileable receptor 300 is shown. Process 400 is shown to include the steps of heat-bonding the polymeric layer 354 to the membrane layer 356 and barrier layer 352 (e.g., acrylic) to form a layered sheet 362 (step 402), forming the structural layer 350 into a receptor shape (e.g., receptor shapes shown in FIGS. 2-5) (step 404), and coupling (e.g., bonding) the layered sheet 362 to the structural layer (step 406).

At step 402, the surfaces of polymeric layer 354, or the entire polymeric layer 354, is heated to at least its glass transition temperature, according to some embodiments. In an exemplary embodiment, membrane layer 356 is heat-bonded to one side of the polymeric layer 354, and the barrier layer 352 is coupled to the opposing side of the polymeric layer 354. In some embodiments, barrier layer 352, polymeric layer 354, and membrane layer 356 are heated together and subsequently pressed to heat-bond or thermoform the sheets together into a layered structure (e.g., a layered sheet 362). The layered sheet 362 may be stored for future use and thus may be produced in large quantities. In some embodiments, the layered sheet 362 is planar and is applied to a planar surface (e.g., walls 110, 112, 114, ceiling 108, etc.) to facilitate tiling on the surface.

In some embodiments, the polymeric layer 354 is heated to the glass transition temperature, and discrete components are added to the polymeric layer 354 to provide a textured coupling surface to the polymeric layer 354. In some embodiments, the discrete components are pressed into the molten polymeric layer 354.

At step 404, structural layer 350 is formed into a receptor shape (e.g., receptor shapes shown in FIGS. 2-5). In some embodiments, and as described above, the structural layer 350 is a fiber-reinforced composite. In some embodiments, the polymer of the fiber reinforced composite is a thermoplastic polymer. In an exemplary embodiment, the fiber-reinforced composite of the structural layer 350 is thermoformed into a receptor shape. In some embodiments, thermoforming the structural layer 350 includes heating the material of the structural layer 350 to its softening point, and stretching and drawing the material into or over a die in the shape of the receptor, as known in the art. In some embodiments, the fiber-reinforced composite of structural layer 350 is sprayed onto or otherwise applied (e.g., laid, brushed, etc.) to a mold or a casting of the receptor shape. In such embodiment, structural layer 350 may be removed from the mold or casting of the receptor shape to yield a structural layer 350 in the desired receptor shape.

At step 406, the layered sheet 362 (e.g., membrane layer 356, polymeric layer 354, and barrier layer 352) is thermoformed to the structural layer 350. In some embodiments, the structural layer 350 may be fully hardened (e.g., set, cured, etc.) before the layered sheet 362 is applied to the structural layer 350. In some embodiments, the layered sheet 362 is applied to the structural layer 350 using an adhesive or a second thermoforming process. In some embodiments, the layered sheet 362 is formed into a receptor shape similar to the receptor shape of the structural layer 350. In such embodiments, the layered sheet 362 may be heat-bonded to the structural layer 350 by placing the formed layered sheet 362 in (e.g., on top of) the formed structural layer 350 and pressing the components together while simultaneously heating the components. In some embodiments, the thermoplastic layers melt together (e.g., each reaches its glass transition temperature) to form a composite layered structure (e.g., the composite layered structure of the tileable receptor 300 shown in FIG. 7). In some embodiments, the layered sheet 362 does not include a barrier layer 352 and structural layer 350 is directly bonded to polymeric layer 354. In such embodiments, the materials used in the structural layer 350 and the polymeric layer 354 are compatible (e.g., do not have undesirable chemical interactions) when subjected to heat (e.g., during thermoforming, during operational use when a user is bating using heated water, etc.), and loads or impacts. For example, it may be undesirable for polymeric layer 354 to become brittle or otherwise have modified material properties leading to damage (e.g., cracking or splitting) due to chemical interactions with an incompatible resin used in structural layer 350.

Figure 9:
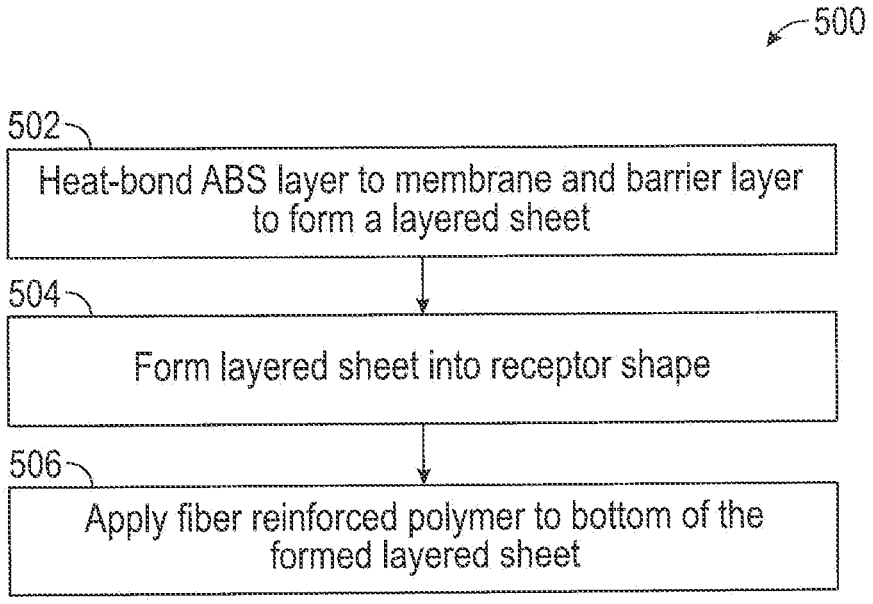
FIG. 9 is a flowchart of fabricating a tileable receptor, according to some embodiments.

Referring now to FIG. 9, a flow diagram of a process 500 for fabricating a tileable receptor is shown, according to some embodiments. Process 500 is shown to include heat-bonding polymeric layer to membrane layer 356 and barrier layer 352 to form a layered sheet 362 (step 502), forming the layered sheet 362 into a receptor shape (e.g., receptor shapes shown in FIGS. 2-5) (step 504), and applying structural layer 350 to the bottom of the formed layered sheet 362 (step 506).

At step 502, the surfaces of polymeric layer 354, or the entire polymeric layer 354, is heated to at least its glass transition temperature, according to some embodiments. In an exemplary embodiment, membrane layer 356 is heat-bonded to one side of the polymeric layer 354, and the barrier layer 352 is coupled to the opposing side of the polymeric layer 354. In some embodiments, barrier layer 352, polymeric layer 354, and membrane layer 356 are heated together and subsequently pressed to heat-bond or thermoform the sheets together into a layered structure (e.g., a layered sheet 362). The layered sheet 362 may be stored for future use, and thus may be produced in large quantities. In some embodiments, the layered sheet 362 is planar and is applied to a planar surface (e.g., walls 110, 112, 114, ceiling 108, etc.) to facilitate tiling on the surface.

At step 504, the process 500 involves thermoforming the layered sheet 362 formed during step 502 into a receptor shape. The receptor shape may be the receptor shape shown in FIGS. 2-5, according to some embodiments.

At step 506, the process 500 involves applying the material of the structural layer 350 (e.g., fiber reinforced composite, fiber reinforced polymer, fiberglass composite structure, etc.) to the bottom (e.g., the barrier layer 352) of the layered sheet 362. In some embodiments, the material of the structural layer 350 may be sprayed or painted onto the bottom of the layered sheet 362. In some embodiments, the structural layer 350 is applied to the bottom of the formed layered sheet 362 to reinforce the formed shape (e.g., the structural form) of the layered sheet 362.

Although the steps above have been described as subsequent steps, it is contemplated that one or more steps may be performed concurrently. For example, step 502 and step 504 may be performed at the same time by placing membrane layer 356, polymeric layer 354, and barrier layer 352 into a die and simultaneously heating and pressing the layers together to (a) bond the layers together via heat-bonding, and (b) form the layers into the desired receptor shape.

Figure 10:
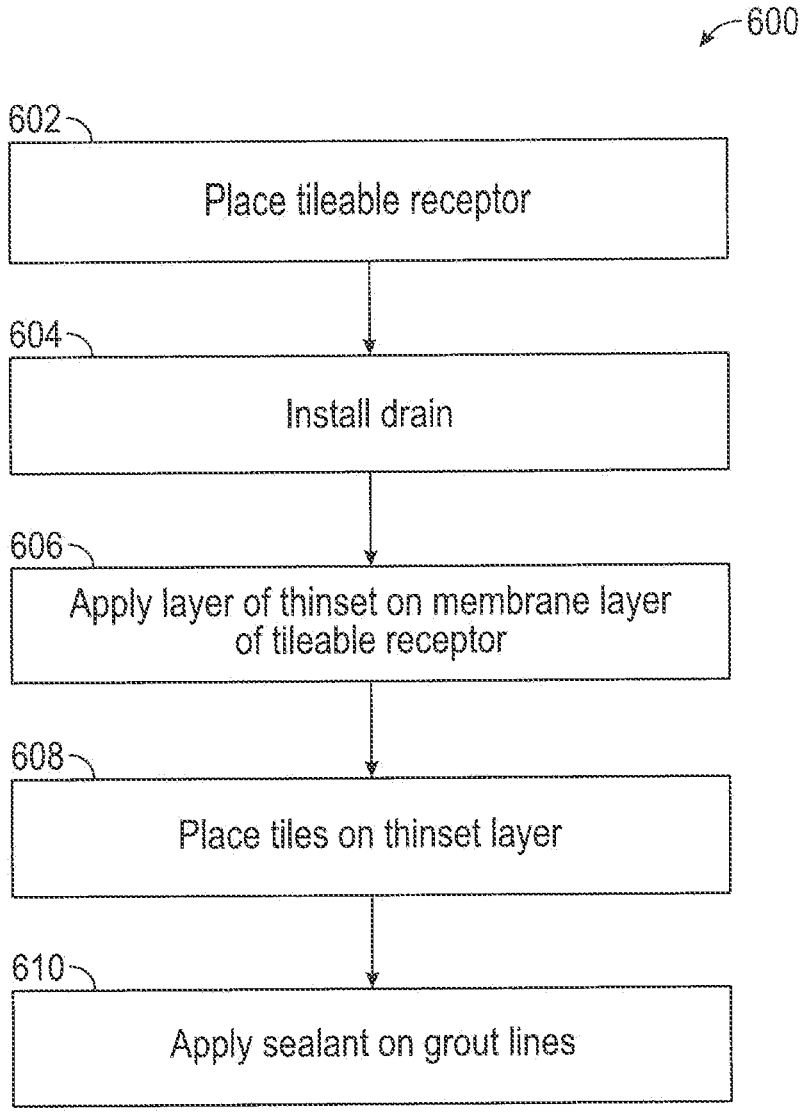
FIG. 10 is a flowchart of installing a tileable receptor, according to some embodiments.

Referring now to FIG. 10, a flow diagram of a process 600 for installing a tiled surface is shown, according to some embodiments. Process 600 is shown to include placing a tileable receptor (e.g., tileable receptor 300) in a suitable location (step 602), installing hardware (step 604), applying a layer of thinset to membrane layer 356 (step 606), placing tiles on thinset layer 342 (step 608), and applying sealant to grout lines (step 610).

At step 602, an installer may acquire (e.g., purchase) a suitable tileable receptor 300 for a suitable location (e.g., shower 100). For example, if shower 100 has a base dimension of 60 inches by 42 inches, the suitable tileable receptor 300 may be sized similarly. In another example, a suitable tileable receptor 300 may be selected based on the drain location within shower 100. For example, in some embodiments, shower 100 includes a single drain that is left offset, and may require a user to acquire a tileable receptor having a left offset drain (e.g., tileable shower receptor 200). In some embodiments, tileable receptor 300 is available in a variety of sizes, shapes, dimensions, and configurations, to accommodate various suitable installation locations (e.g., shower 100). In an exemplary embodiment, a user my place the receptor on the floor and dry fit the tileable receptor 300 in the suitable location (e.g., shower 100) to ensure a proper fit. In some embodiments, the installer may level or make adjustments to the subfloor to facilitate a level and secure fitment of the tileable receptor 300.

At step 604, the installer may install the necessary hardware to fluidly couple the tileable receptor 300 to the plumbing in the suitable location. For example an installer may install a drain 308 in drain area 306 that is fluidly coupled to the plumbing of the shower 100. In some embodiments, step 604 involves the installer securing the tileable receptor 300 to the floor underneath the shower 100. In some embodiments, the tileable receptor 300 is secured and sealed with walls 110, 112, 114 using a sealant (e.g., silicone, caulk, latex, acrylic) or sealing hardware (e.g., gaskets, washers, etc.). Advantageously, the necessary slope, waterproofing, and substrate surface (e.g., membrane layer 356) is provided by the tileable receptor 300, and the installer may begin tiling (e.g., applying thinset and tiles) immediately. In some embodiments, the installer may install foam or other material underneath the tileable receptor. In some embodiments, the installer may install a sound-deadening material underneath the tileable receptor 300 configured to reduce or eliminate a sound associated with an operation of the tileable receptor 300 (e.g., fluid drainage sounds, a reverberation of fluid landing on the tiled surface on the tileable receptor 300, a user walking on the receptor 300, etc.). In some embodiments, the tileable receptor 300 includes factory-installed sound deadening features (e.g., sound deadening material such as sound deadening mats or sound deadening foams that reduce or eliminate hollow sounds. In some embodiments, the tileable receptor 300 has an acoustic profile similar to a conventional sub-tile base (e.g., concrete, a mud pan, etc.).

At step 606, the installer may apply a thinset layer (e.g., adhesive, mortar, tile mortar, etc.) 342 to the membrane layer 356. The thinset layer 342 may interact with the membrane layer 356 and as described with respect to FIGS. 6 and 7. Thinset layer 342 may be applied using a trowel having proper notch shapes (e.g., V-notch, U-notch, square-notch, etc.) and notch sizes (e.g., 0.1 inch, 0.5 inch, etc.) for the desired tiles of tile layer 340 to provide proper support (e.g., contact area) and adhesion of the tile layer 340 on the thinset layer 342.

At step 608, the installer may place a tile layer 340 on the thinset layer 342 before the thinset layer 342 cures or sets. The tile layer 340 may include any tiles of any shape, color, dimension, material, etc., known in the art to be compatible with the material of the thinset layer 342. In some embodiments, the material of thinset layer 342 is selected to be suitable for use with tile layer 340 and the material of membrane layer 356. In some embodiments, the material of thinset layer 342 is selected to be suitable for use in a wet or damp environment (e.g., shower 100).

At step 610, the installer may apply a sealant on the top of the grout lines between the tiles of tile layer 340 for aesthetic or functional purposes. For example, the grout may be applied to tile layer 340 that has a slightly different appearance (e.g., color) than desired by the user or installer, and the sealant may be applied to mask or cover the unsightly grout. In some embodiments, a sealant is applied to the grout lines to provide an additional barrier to prevent water from penetrating the tileable receptor 300 (i.e., a functional purpose).

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. For example, drain area 206 of the exemplary embodiment shown in at least FIG. 2 may be incorporated in the tileable receptor 300 of the exemplary embodiment shown in at least FIG. 3. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A shower system for use in a shower environment, the shower system comprising:

a pre-fabricated tileable receptor configured for installation in the shower environment to provide a base for installing a tiled surface on top of the tileable receptor, the tileable receptor comprising a drain area and a sloped portion configured to direct a liquid toward the drain area, the tileable receptor being made of a layered material comprising:

a structural layer configured to maintain a shape of the sloped portion;

a polymeric layer supported by the structural layer;

a barrier layer extending between the polymeric layer and the structural layer; and a membrane layer coupled with a top surface of the polymeric layer and comprising a surface texture, wherein the membrane layer facilitates a mechanical bond with a tile adhesive material.

2. The system of claim 1, wherein the structural layer comprises a fiber reinforced composite material.

3. The system of claim 2, wherein the membrane layer is thermoformed to the polymeric layer.

4. The system of claim 2, wherein the membrane layer comprises a fibrous material having a higher melting point or glass transition temperature than a melting point or glass transition temperature of the polymeric layer.

5. The system of claim 2, wherein the polymeric layer comprises acrylonitrile butadiene styrene, and wherein the polymeric layer is water impermeable.

6. The system of claim 2, wherein a thickness of the polymeric layer is less than a thickness of the structural layer.

7. The system of claim 2, wherein, the barrier layer is made of a heat formable acrylic material.

8. The system of claim 1, wherein the structural layer is made of at least one of a fiberglass reinforced material or an oriented strand board material.

9. The system of claim 1, wherein the tileable receptor further comprises a flange defined on a perimeter of the tileable receptor, wherein the flange is configured to be coupled to a surface of the shower environment.

10. The system of claim 1, wherein the tileable receptor further comprises one or more side walls extending upward from a perimeter portion of the sloped portion and configured to contain the liquid within the perimeter portion.

11. The system of claim 1, wherein the sloped portion includes a conical portion around the drain area, wherein the conical portion has a uniform pitch.

12. A pre-fabricated tileable receptor for use in a shower environment to provide a base for installing a tiled surface on top of the tileable receptor, the tileable receptor comprising:

a drain area;

a sloped portion configured to direct liquid toward the drain area; and a layered material comprising:

a structural layer made of a fiber reinforced material;

a polymeric layer configured to be water impermeable;

a barrier layer extending between the polymeric layer and the structural layer; and a membrane layer coupled with a top surface of the polymeric layer and comprising a surface texture configured to promote a mechanical bond between the membrane layer and a tile adhesive material.

13. The tileable receptor of claim 12, wherein the membrane layer comprises a fibrous material having a higher melting point or glass transition temperature than a melting point or glass transition temperature of the polymeric layer.

14. The tileable receptor of claim 13, wherein the polymeric layer comprises acrylonitrile butadiene styrene.

15. The tileable receptor of claim 12, wherein a thickness of the polymeric layer is less than a thickness of the structural layer.

16. The tileable receptor of claim 13, wherein the barrier layer is made of a heat formable acrylic material configured to prevent chemical interactions between the structural layer and the polymeric layer.

17. A method of installing a tiled surface in a shower environment, the method comprising:

obtaining a pre-fabricated tileable receptor defining a drain area and a sloped portion, the tileable receptor made of a layered material comprising a structural layer, a polymeric layer supported by the structural layer, a barrier layer extending between the polymeric layer and the structural layer, and a membrane layer coupled to a top surface of the polymeric layer, the membrane layer having a surface texture that promotes mechanical bonding between the membrane layer and a tile adhesive;

coupling the tileable receptor to the shower environment to provide a base for installing a tiled surface on top of the tileable receptor;

applying a tile adhesive layer to the surface texture of the membrane layer; and applying a plurality of tiles to the tile adhesive layer to firm the tiled surface on top of the tileable receptor.

18. The method of claim 17, wherein the structural layer is a fiber reinforced material, and wherein the layered material is formed by a heat-bonding process.

19. The method of claim 18, wherein the sloped portion defines a receptor profile, and wherein the receptor profile is different than a surface of the shower environment.

20. The method of claim 18, wherein the polymeric layer is a water impermeable material, and wherein the membrane layer comprises a fabric material that is heat bonded to the polymeric layer.

* * * * *